United States Patent [19]

Wolf

[11] 4,385,537

[45] May 31, 1983

[54] APPARATUS FOR ENGAGING AND TRANSPORTING DISCRETE SHEETS OF PAPER OR THE LIKE

[75] Inventor: Wolfram Wolf, Bilsen, Fed. Rep. of Germany

[73] Assignee: E.C.H. Will (GmbH & Co.), Hamburg, Fed. Rep. of Germany

[21] Appl. No.: 263,075

[22] Filed: May 12, 1981

[30] Foreign Application Priority Data

May 24, 1980 [DE] Fed. Rep. of Germany ..... 3019973

[51] Int. Cl.[3] ..... B26D 1/62; B65H 35/08

[52] U.S. Cl. ..... 83/100; 83/152; 83/154; 83/155; 83/345; 271/273; 271/275

[58] Field of Search ..... 83/100, 152, 154, 155, 83/345; 271/273, 275

[56] References Cited

U.S. PATENT DOCUMENTS

| | | | |
|---|---|---|---|
| Re. 27,768 | 10/1973 | Deslauriers | 83/152 X |
| 3,192,807 | 7/1965 | Haselow et al. | 83/152 X |
| 3,446,103 | 5/1969 | Foster | 83/155 X |
| 4,189,965 | 2/1980 | Kollann | 83/155 |
| 4,201,102 | 5/1980 | Rudszinat | 83/298 |
| 4,255,998 | 3/1981 | Rudszinat | 83/298 |

*Primary Examiner*—Frank T. Yost
*Attorney, Agent, or Firm*—Kontler, Grimes & Battersby

[57] ABSTRACT

An apparatus for engaging and transporting discrete sheets downstream of a severing station at which a cross-cutter severs a running paper web has a catcher assembly with an upper and a lower conveyor unit. The conveyor units define an elongated path for the transport of sheets therebetween. The catcher assembly is adjustable, in its entirety, with reference to the severing station, and each conveyor unit is adjustable relative to the other conveyor unit. The rearmost portion of the upper conveyor unit is adjustable toward and away from the adjacent portion of the lower conveyor unit. Such adjustability of the catcher assembly, of the conveyor units and of the rear portion of the upper conveyor unit enables an attendant to counteract the tendency of the leader of the web to miss the entrance into the path for successive sheets between the upper and lower conveyor units regardless of whether such tendency is attributable to the propensity of the web to curl, to excessive or pronounced flexibility of the material of the web, to the weight of the material of the web, to the generation of eddy currents at the severing station owing to rotary movement of the severing instrumentalities, and/or any combination of such factors.

19 Claims, 1 Drawing Figure

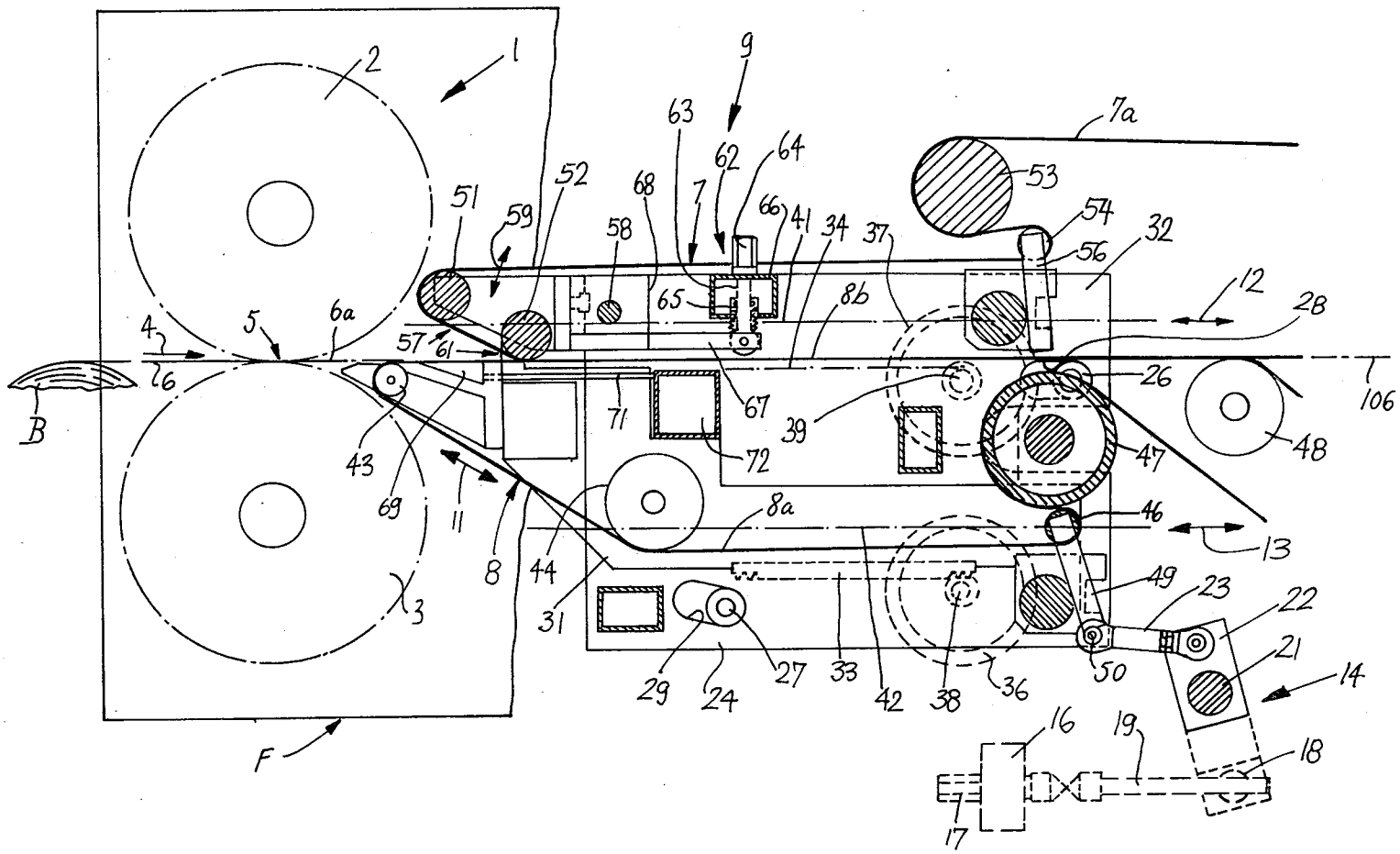
106
28
48
14
18
22
21
13
12
23
32
26
47
46
49
50
19
7a
54
56
53
16
36
17
38
37
42
39
33
34
86
41
64
66
9
62
7
63
67
72
8a
27
24
65
29
68
58
71
52
44
31
59
8
51
61
57
II
69
43
3
2
6a
5
F
4
6
B
I

APPARATUS FOR ENGAGING AND TRANSPORTING DISCRETE SHEETS OF PAPER OR THE LIKE

BACKGROUND OF THE INVENTION

The present invention relates to apparatus for manipulating sheets which consist of flexible material, such as thin paper, plastic foil or the like. More particularly, the invention relates to improvements in apparatus for engaging and transporting discrete sheets of paper or the like downstream of a device which subdivides a running tape band, web or strip of flexible material into discrete panels or sheets. Still more particularly, the invention relates to improvements in apparatus of the type wherein an oncoming sheet enters an elongated path which is defined by two conveyor units forming part of a so-called catcher assembly.

It is already known to intercept and guide sheets of paper or the like immediately downstream of the station or locus where the sheets are formed, e.g., downstream of a cross cutter which normally includes drum-shaped rotary knife holders serving to sever a running strip, tape, band or web of paper or the like (hereinafter referred to as paper web or simply web) at predetermined (normally regular) intervals so that the web yields a succession of discrete sheets or panels which are transported to the next processing station, e.g., to a stacker where the sheets are piled up on top of each other preparatory to packaging, binding or another treatment. As a rule, the path for the running web is horizontal or substantially horizontal so that one of the rotary knife holders is located above and the other knife holder is disposed below the horizontal path. Cross cutters which can be utilized to subdivide a running paper web into a succession or file of discrete sheets are disclosed, for example, in U.S. Pat. Nos. 4,201,102 and 4,255,998 granted to Willy Rudszinat. For the sake of convenience, the disclosures of the patents to Rudszinat are incorporated herein by reference. During severing, the knives which are carried by and orbit about the axes of the respective rotary holders advance in the direction of transport and at the speed of movement of the running web. The leader of the freshly severed sheet or the leader of the web immediately downstream of the cutting plane is supposed to enter a predetermined path so as to ensure that each and every sheet will be transported in a predictable way and will reach the next processing station in a predetermined orientation as well as after elapse of a preselected interval of time following arrival of the preceding sheet. Such task cannot be performed by heretofore known sheet intercepting, guiding and transporting apparatus with a requisite degree of predictability and reproducibility. The reasons for unreliable operation of heretofore known sheet engaging and transporting apparatus are numerous and include the inability of such apparatus to adequately compensate for the tendency of sheets to flex or curl and/or for the tendency of currents of air which develop as a result of orbital movement of the knives to change the direction of movement of the sheets so that the leaders of the sheets often strike against rather than slide along the guide means downstream of the severing location, as well as insufficient versatility (especially the inability of conventional apparatus to conform their mode of operation to changes in flexibility, dimensions and/or consistency of the material of the web) and/or a combination of such factors. It has been found that the leader of the freshly severed sheet or the leader of the running web often exhibits a pronounced tendency to curl, not only because the severing device normally receives the web from a source of supply wherein the web is stored in the form of a roll (i.e., that the web exhibits a tendency to curl in the same direction in which it was wound on the core of a reel or the like) but also due to gravity since the path for discrete sheets or downstream of the severing location is normally horizontal or substantially horizontal. The center of curvature of the leader of the web and/or of the leaders of successive sheets is located below the selected path for the sheets, and the length of the radius of curvature of the curling leading end of the web or the leading end of each discrete sheet depends on the tendency of the web to curl as well as on the flexibility of the material of the web and the weight or mass of the flexible stock per unit of length.

The just discussed tendency of the freshly formed sheets to leave their desired path presents many problems, especially in high-speed paper processing machines, because the quality of the ultimate product (e.g., a wrapped and packed ream of stacked paper sheets or a stack of ruled paper sheets which are assembled into a steno pad, exercise book or the like) depends to a considerable degree on the accuracy with which the sheets are guided in the region immediately downstream of the severing location.

OBJECTS AND SUMMARY OF THE INVENTION

An object of the invention is to provide a novel and improved apparatus which can be used for predictable guidance of discrete sheets downstream of the location where the sheets are formed by repeated severing of a running web of paper or the like.

Another object of the invention is to provide a highly versatile sheet engaging and transporting apparatus which can be rapidly converted for the processing of relatively thick, relatively thin, relatively large or relatively small sheets as well as for predictable manipulation of sheets which exhibit a pronounced or minimal tendency to curl downstream of the severing location.

A further object of the invention is to provide novel and improved means for selecting the positions of various components of the above outlined apparatus with reference to the severing location and/or with reference to the path of movement of the running web.

An additional object of the invention is to provide a paper processing machine which embodies a sheet engaging and transporting apparatus of the above outlined character.

Still another object of the invention is to provide novel and improved means for reliably guiding the leader of a running paper web which is in the process of being converted into a succession of discrete sheets.

A further object of the invention is to provide an apparatus which is capable of predictably engaging and transporting successive discrete sheets downstream of the severing location and which is also ideally suited to predicatably guide the leader of the running web irrespective of the frequency at which the web is severed and irrespective of the tendency of the web to curl immediately downstream of the severing location.

Still another object of the invention is to provide an apparatus which can securely guide the leader of a running web of paper or the like between the severing station and the location where the leader can be positively engaged and transported in a desired direction and along a desired path.

A further object of the invention is to provide an apparatus which can compensate for the tendency of the leader of a running web to leave its prescribed path for any one of numerous reasons which are attributable to the characteristics of the web, to the mode of storing the web, to the mode of severing the web, and/or to the nature of the severing apparatus.

The invention is embodied in a machine for converting a running web of paper or the like into a succession of discrete panels or sheets wherein the web is transported lengthwise along a first path and its leader is severed at a severing station to yield a succession of discrete sheets. More particularly, the invention resides in the provision of a combination of parts or components which is embodied in such machine and includes an apparatus for engaging and transporting successive sheets in a direction away from the severing station and along a second path. The apparatus comprises a sheet catcher assembly including first sheet-engaging conveyor means at one side and second sheet-engaging conveyor means at the other side of the second path, means for adjusting the catcher assembly relative to the severing station, means for adjusting the first conveyor means relative to the second conveyor means, and means for adjusting the second conveyor means relative to the first conveyor means.

The second path is preferably at least substantially horizontal, and the first conveyor means is then located at a level above the second conveyor means.

The combination further comprises means for severing the running web at the severing station, and such severing means preferably comprises a cross cutter. For example, the cross cutter may comprise a first rotary knife holder at one side and a second rotary knife holder at the other side of the first path.

The means for adjusting the entire catcher assembly relative to the severing station preferably includes means for moving at least a portion of the catcher assembly in a direction at an acute angle to the direction of travel of sheets away from the severing station. The combination also comprises means for guiding the catcher assembly during movement relative to the severing station.

At least one of the adjusting means for the conveyor means preferably includes means for moving the respective conveyor means in substantial parallelism with the first path and/or second path. Also, the combination preferably comprises guide means which confines each conveyor means to movement along a predetermined path relative to the other conveyor means, preferably in parallelism with the first and/or second path.

That (first) conveyor means which is located at a level above the second path (if the second path is at least substantially horizontal) preferably includes a first portion which is more distant from and a second portion which is nearer to (e.g., closely or immediately adjacent to) the severing station. The second portion may constitute a so-called dabbing device in the form of a mouthpiece which is adjustable transversely of the second path toward and away from the adjacent portion of the other (second) conveyor means to define therewith a nip for entry of the leader of the web into the second path. The adjusting means for the mouthpiece may comprise a lever which is pivotable to thereby move the mouthpiece transversely of the second path.

The means for adjusting the catcher assembly may comprise a linkage, and the means for adjusting the conveyor means may include rack-and-pinion drives.

Still further, the apparatus can comprise a suction chamber adjacent to one side of the second path and arranged to attract the leader of the web downstream of the severing station. This suction chamber can be disposed opposite the aforementioned mouthpiece so that the leader of the web can enter the second path by advancing between the mouthpiece and the suction chamber.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a somewhat schematic partly elevational and partly longitudinal vertical sectional view of an apparatus which is utilized to engage and transport discrete paper sheets downstream of a cross cutter serving to subdivide a running paper web into a succession of discrete sheets.

DESCRIPTION OF THE PREFERRED EMBODIMENTS

The drawing shows two rotary drum-shaped knife holders 2 and 3 which form part of a cross cutter 1, namely, a device which subdivides a running band, tape, web or strip 6 (hereinafter called web or paper web) of paper or the like into a succession or file of discrete sheets or panels 106 of predetermined length. The knives (not specifically shown) which are carried by the rotary holders 2 and 3 are caused to advance in the direction of transport (see the arrow 4) and at the exact speed of movement of the web 6, at least during those stages of successive revolutions of the knife holders when the knives cooperate to form a transverse cut (namely, a cut at right angles to the plane of the drawing) so as to separate a fresh sheet 106 from the leader of the web 6. Reference may be had to the aforementioned U.S. Pat. Nos. 4,201,102 and 4,255,998 to Rudszinat which disclose suitable mechanisms and drives capable of controlling the speed of orbital movement of each knife in the course of each of a series of successive severing operations.

The invention resides in the provision of a novel and improved apparatus which is installed downstream (preferably immediately downstream) of the severing location or station 5 and serves to engage and transport successive sheets 106 and/or to guide the leader **6*a* of the running web 6 so that each sheet 106 is guided along the same path as the preceding sheet 106 as well as that the leader 6*a* of the running web 6 invariably finds its way into such path without creasing, folding, knurling and/or other deformation and/or damage thereto. The leader 6*a* of the web 6 normally or often exhibits a tendency to curl, either upwardly or downwardly, depending on the direction in which the web was convoluted on a bobbin or reel (B) upstream of the severing station 5, and depending further on the intensity and direction of circulation of currents of air which develop at and/or immediately downstream of the station 5 as a result of orbital movement of knives at the peripheries of the rotating knife holders 2 and 3 when the cross cutter 1 is in use. In the illustrated embodiment, the web 6 is supplied to the severing station 5 along a first substantially or exactly horizontal path, and the sheets 106 which are obtained in response to repeated severing of the running web 6 are transported along a second horizontal or substantially horizontal path which is defined by the upper and lower conveyor units 7, 8 of a sheet catcher assembly 9** forming part of the improved sheet entraining and transporting apparatus.

In accordance with a feature of the invention, the entire sheet catcher assembly 9 is shiftable in the directions indicated by a double-headed arrow 11, namely, at an acute angle to the longitudinal direction of the path of sheets 106 and in directions toward and away from the severing station 5. In addition, each of the conveyor units 7, 8 is movable independently of the other conveyor unit. The directions in which the upper conveyor unit 7 is adjustable relative to the lower conveyor unit 8 are indicated by a double-headed arrow 12, and the directions in which the lower conveyor unit 8 is adjustable independently of the upper conveyor unit 7 are indicated by a double-headed arrow 13. These directions are parallel or substantially parallel to the path of the sheets 106.

The means for adjusting the entire sheet catcher assembly 9 relative to the cross cutter 1 comprises a linkage 14 which is shown in the lower right-hand portion of the drawing and includes a rotary input element 17 in the form of a fluted or grooved bolt or stud rotatable in a stationary bearing member 16 which is installed in the frame F of the machine including the cross cutter 1 and the improved sheet engaging and transporting apparatus. The input element 17 can be rotated (clockwise as well as counterclockwise) by hand, by a suitable tool or by a motor to transmit torque to a feed screw 19 meshing with a nut 18 which is connected to the lower arm of a two-armed lever 22. The lever 22 is pivotable on or with a fixedly mounted shaft 21, and its upper arm is articulately connected to a link 23. The latter is coupled to the adjacent corner portion of a plate-like wall member or cheek 24. The conveyor units 7 and 8 are mounted on and in the space between the cheek 24 and a similar cheek (not shown) which latter has been omitted in order to expose the constituents of the two conveyor units and other component parts of the sheet engaging and transporting apparatus.

The two wall members or cheeks 24 are movably installed in the frame F of the aforementioned machine. The frame F carries two horizontal guide pins 26 and 27 which respectively extend into elongated guide slots 28 and 29 of the cheeks 24. The slot 28 is substantially horizontal, and the inclination of the slot 29 matches that of the arrow 11, i.e., the longitudinal direction of the slot 29 makes an acute angle with the path of movement of sheets 106 away from the severing station 5. When the input element 17 is rotated clockwise or counterclockwise, the lever 22 pivots about the axis of the shaft 21 and the link 23 causes the cheeks 24 to move relative to the frame F, either toward the station 5 or away from the cross cutter 1. The guide pin 26 causes the adjacent portions of the cheeks 24 to move along a substantially horizontal path but the guide pin 27 cooperates with the inclined slots 29 of the cheeks 24 to cause the catcher assembly 9 to move its left-hand portion (as viewed in the drawing) at an acute angle to the longitudinal direction of the elongated path of the sheets 106 as well as to the longitudinal direction of the path of the web 6.

The adjusting means for the upper conveyor unit 7 comprises a hand wheel 37 which is rotatably mounted on the illustrated cheek 24 and can rotate a pinion 39 (e.g., a fluted shaft) which meshes with an elongated toothed rack 34 secured to a carrier 32 for the component parts of the upper conveyor unit 7.

The adjusting means for the lower conveyor unit 8 comprises a second hand wheel 36 which can rotate a pinion 38 journalled in the illustrated cheek 24 and meshing with a toothed rack 33 secured to a carrier 31 for component parts of the conveyor unit 8. The toothed racks 33 and 34 are substantially horizontal, i.e., they are parallel with the path of movement of discrete sheets 106 in a direction away from the severing station 5.

The cheeks 24 are provided with grooved guides 41 and 42 for the respective carriers 31 and 32. These guides (denoted by phantom lines because the exact construction thereof forms no part of the invention) can constitute integral parts of or they may be attached to the cheeks 24 and serve to confine the carriers 31 and 32 to movements which are respectively indicated by the double-headed arrows 13 and 12.

The lower conveyor unit 8 comprises one or more endless flexible elements **8*a* (e.g., belts) which are trained over a series of rotary elements in the form of pulleys 43, 44, 46, 47 and 48. The pulley 46 constitutes a tensioning means for the flexible element or elements 8*a* and is mounted at the upper end of a one-armed lever 49 which is pivotable in one or both cheeks 24, for example, so as to turn about the axis of the horizontal pivot member 50 which couples the link 23 to the illustrated cheek 24. The lever 49 is biased in a manner which is not specifically shown in the drawing so as to maintain the flexible element or elements 8*a* under requisite tension in spite of the fact that the conveyor unit 8 is movable relative to the cheeks 24, i.e., lengthwise of the guide means 42**.

The upper conveyor unit 7 comprises one or more endless flexible elements **7*a* (e.g., belts) which are trained over a series of rotary elements in the form of pulleys 51, 52, 53 and 54 (additional pulleys for the flexible elements 7*a* and 8*a* are located to the right of the cheeks 24 and are not specifically shown in the drawing). The pulley 54 constitutes or forms part of a means for tensioning the flexible element or elements 7*a* and is mounted on a spring-biased lever 56 which maintains the flexible element or elements 7*a* under requisite tension in spite of the fact that the entire conveyor unit 7 is shiftable (with its carrier 31) lengthwise of the guide means 41 on the cheek or cheeks 24**.

The two rearmost pulleys 51 and 52 of the conveyor unit 7 constitute a so-called dabbing device here shown as a mouthpiece 57 which serves to steer the leader **6*a* of the web 6 into the nip 61 of the flexible elements 7*a* and 8*a* in the region immediately or closely downstream of the severing station 5. The mouthpiece 57 is adjustable in directions indicated by a double-headed arrow 59 by a mechanism 62, namely, they are pivotable as a unit about the axis of a fixed horizontal shaft 58 installed in the carrier 32 and mounting a block-shaped supporting member 68 for the pulleys 51 and 52. The mechanism 62 includes an adjusting nut 64 which can rotate an upright bolt 63 the lower end portion of which is articulately connected to an elongated lever 67 attached to the supporting member 68 for the pulleys 51 and 52. A spring 65 biases the lever 67 in a clockwise direction, as viewed in the drawing, and reacts against a housing 66 for the nut 64 and bolt 63. The nut 64 can be rotated by hand, by a tool or by a motor. The purpose of the mouthpiece 57 is to vary the width of the nip 61** between the flexible elements *7a* and *8a* in dependency on or in order to account for the flexibility, composition and/or other characteristics (including the tendency to curl) of the leader *6a* of the web 6. Actually, the mouthpiece 57 will determine the force with which the leader *6a* is engaged and entrained by the flexible elements *7a* and *8a*. As a rule, the leader *6a* will be located in the path between the flexible elements *7a* and *8a* before the cross-cutter 1 severs the web 6 behind the leader *6a* so that the leader *6a* then constitutes the leading end of a freshly formed (rearmost) discrete sheet 106.

The upper reach or reaches *8b* of the flexible element or elements *8a* forming part of the lower conveyor unit 8 advance above the open or partially open upper side of a suction chamber 69 which is mounted on the cheeks 24 immediately downstream of the severing station 5 and serves to attract the adjacent portion of the web 6 and/or nearest sheet 106. The connection between the suction chamber 69 and a suction generating device (e.g., a fan or blower) comprises one or more channels 71 which communicate with a main suction line 72 leading to the suction intake of the aforementioned fan. The suction chamber 69 is located opposite the mouthpiece 57, and its upper side can be partially or fully overlapped by the upper reach or reaches *8b*, depending upon whether or not the flexible element or elements *8a* consist of air-permeable material.

The operation of the sheet engaging and transporting apparatus is as follows:

The possibility of adjusting the position of the catcher assembly 9 relative to the frame F, of adjusting the conveyor unit 7 relative to the cheeks 24 independently of the conveyor unit 8, of adjusting the conveyor unit 8 relative to the cheeks 24 independently of the conveyor unit 7 and/or of adjusting the mouthpiece 57 relative to the remaining portion of the conveyor unit 7 as well as relative to the conveyor unit 8 enables the attendant or attendants to carry out any one of a large number of adjustments in order to ensure that the leader *6a* of the web 6 invariably enters the nip 61 as well as that successive discrete sheets 106 are predictably transported toward the next processing station. Moreover, the attendant or attendants can carry out the necessary adjustments while the machine including the cross cutter 1 is in actual use so that the adjustments compensate for eventual deviations from an optimum mode of operation. An attendant who is at least slightly experienced in the relevant art can readily ascertain the causes of malfunctions and can immediately undertake the necessary steps without slowing down or arresting the machine.

For example, an attendant can detect the tendency of the web 6 to pile up in front of the nip 61 (as well as actual pileups in front of the nip 61), i.e., the inability of the leader *6a* to enter the path between the neighboring reaches of the flexible elements *7a* and *8a*. Such tendency can be counteracted by rotating the hand wheel 37 so as to move the entire upper conveyor unit 7 in a direction to the right, as viewed in the drawing, i.e., away from the severing station 5.

If the web 6, its leader *6a* and/or the discrete sheets 106 exhibit a pronounced tendency to fluctuate in their respective paths, an attendant will rotate the input element 17 in a direction to move the entire catcher assembly 9 downwardly and away from the severing station 5 (i.e., at the acute angle to the horizontal path for the sheets 106). Such tendency of the web 6 and/or sheets 106 can be attributed to development of eddy currents as a result of orbital movement of the knives about the axes of the respective knife holders 2 and 3. Furthermore, the web 6 and/or the sheets 106 are likely to vibrate or depart from their prescribed paths owing to a pronounced tendency of a web 6 to curl. The operator can also decide to connect the suction chamber 69 to the suction generating device so that the leader *6a* of the web 6 is attracted to the upper reach or reaches *8b* of the flexible elememt or elements *8a;* this also contributes to a reduction of tendency of the web 6 to vibrate downstream of the severing station 5. The valve means which can be actuated to establish or terminate subatmospheric pressure in the suction chamber 69 is not specifically shown in the drawing. Such valve means can be manipulated by hand or automatically, e.g., in response to detection of certain undesirable phenomena in the transport of web 6 and sheets 106.

The lower conveyor unit 8 will be moved or might require a movement lengthwise of the guide means 42 when the machine is converted from the making of longer sheets to the making of shorter sheets or vice versa. Such conversion normally involves changes in the speed of rotary movement of the knife holders 2, 3, replacement of the knives on such holders or replacement of the entire holders 2 and 3.

Predictable and reliable entry of the leader *6a* of a running web 6 into the nip 61 of the flexible elements *7a* and *8a* also depends on the speed of the flexible elements *7a, 8a,* because such speed determines or influences the width of clearances between successive discrete sheets 106 as well as the rate of widening of the gap between the rearmost sheet 106 and the leader *6a* of the web 6. An attendant can regulate the width of aforementioned clearances by the simple expedient of rotating the nut 64 in the appropriate direction, i.e., by moving the mouthpiece 57 toward or away from the suction chamber 69. Such adjustment accounts for the sensitivity, thickness and/or other parameters of the material of the web 6. An adjustment of the mouthpiece 57 can take place while the machine is in use and enables the attendant to accelerate each freshly severed sheet 106 in good time to avoid a collision between the trailing end of such sheet and the leader *6a* of the remaining part of the web 6 as well as to avoid excessive acceleration of sheets or excessive tendency of the mouthpiece 57 to accelerate the leader *6a* of the web prior to severing because this could lead to excessive tensioning of the material of the web and the making of unclean cuts across the web. Otherwise stated, the mouthpiece 57 should ensure that the flexible elements *7a, 8a* are in satisfactory frictional engagement with the web 6 prior to severing so that the elements *7a, 8a* can slide relative to the leader *6a* before the latter is severed but that a freshly severed sheet 106 is immediately accelerated to a speed at least slightly exceeding the speed of the web 6 in order to ensure that the trailing portion of the freshly formed sheet immediately moves away from the station 5 at a speed which exceeds the speed of the web 6. Frictional engagement between the leader *6a* and the flexible elements *7a, 8a* should not be too pronounced because the flexible elements *7a, 8a* would then tend to tear the leader *6a* away from the remaining portion of the web 6 before the knives of the rotary holders 2 and 3 have completed a cut across the web.

An important advantage of the feature that the catcher assembly 9 is adjustable along a path which is inclined with reference to the paths of movement of the sheets 106 and web 6 is that the apparatus can readily compensate for the tendency of the leader 6*a* to curl in either direction. Thus, by adjusting the catcher assembly 9 through the medium of the linkage 14, an attendant can change the level of the path for the sheets 106 relative to the level of the path for the web 6, and such attendant can simultaneously move the conveyor units 7 and 8 nearer to or further away from the severing station 5. This can compensate for or counteract the tendency of the leader 6*a* of the web 6 to flex downwardly or upwardly, i.e., the portion or portions of the flexible element or elements 7*a* between the pulleys 51 and 52 will intercept and change the direction of movement of an upwardly curling leader 6*a*, and the upper reach or reaches 8*b* of the flexible element or elements 8*a* will intercept a downwardly curling leader 6*a* and cause it to enter the nip 61 and thence the prescribed path for transport of discrete sheets 106 toward the next processing station.

Another important advantage of the improved apparatus is that the conveyor units 7 and 8 are adjustable independently of each other, i.e., lengthwise of the respective guide means 41 and 42. Such adjustability enables an attendant to compensate for a very pronounced tendency of the leader 6*a* of a web 6 to curl upwardly or downwardly, i.e., the conveyor unit 7 or 8 will be adjusted relative to the conveyor unit 8 or 7 if an adjustment of the entire catcher assembly 9 by the linkage 14 does not suffice to compensate for the tendency of the leader 6*a* to stray away from the nip 61. Of course, the conveyor unit 7 and/or 8 can be adjusted lengthwise of the respective guide means 41 and/or 42 independently of adjustment of the entire catcher assembly 9, i.e., the conveyor unit 7 or 8 can be shifted toward or away from the cross cutter 1 in the absence of any adjustment of the entire catcher assembly 9 if the attendant realizes or knows that such adjustment suffices to enhance the operation of the apparatus or to compensate for eventual deviations from optimum engagement and transport of successive sheets 106.

A further important advantage of the improved apparatus is that the mouthpiece 57 can be adjusted to change the force with which the flexible elements 7*a* and 8*a* bear against the adjacent portion of flexible material. As explained above, such adjustability of the mouthpiece 57 enables an attendant to select the width of clearances between successive sheets 106 and also the rate of speed at which a freshly severed (rearmost) sheet 106 is moved away from the leader 6*a* of the remaining portion of the web 6 immediately after completion of the last severing operation. This, in turn, renders it possible to avoid collisions between the rearmost sheets 106 and the leader 6*a* of the running web 6 and hence the likelihood of a pileup of flexible material of the web in the space between the severing station 5 and the nip 61.

To summarize, the improved apparatus comprises means which can counteract or compensate for any and all presently known characteristics of a running web that could lead to improper transport of freshly severed or formed sheets to the next processing station. Moreover, the improved apparatus renders it possible to sever the web at a high frequency, i.e., to form a large number of discrete sheets per unit of time without increasing the risk of malfunctioning of the severing means and/or of the means for transporting discrete sheets to the next processing machine or station (the manner in which the speed of flexible elements 7*a* and 8*a* is variable so as to remain proportional to the variable speed of the knife holders 2, 3, i.e., the manner in which the speed of the conveyor units 7 and 8 is variable in order to compensate for eventual or potential changes in the frequency at which the cutter 1 severs the running web 6 is known and is not specifically shown in the drawing). Reference may be had to the aforementioned patents to Rudszinat. Still further, all adjustments can be carried out while the machine embodying the improved apparatus is in actual use so that the adjustment or adjustements do not necessitate any slowdown and/or stoppage of the machine. The adjustments are simple and can be completed with little loss in time so that a deviation from optimum operation (i.e., optimum forming and transport of discrete sheets) can be eliminated practically immediately after detection.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine for converting a running web of paper or the like into a succession of discrete sheets wherein the web is transported lengthwise along a first path and its leader is severed at a severing station to yield a succession of discrete sheets, the combination of an apparatus for engaging and transporting successive sheets in a direction away from said station and along a second path, comprising a sheet catcher assembly including first sheet-engaging conveyor means at one side and second sheet-engaging conveyor means at the other side of said second path; means for adjusting said catcher assembly relative to said station; means for adjusting said first conveyor means relative to said second conveyor means; and means for adjusting said second conveyor means relative to said first conveyor means.

2. The combination of claim 1, wherein said second path is substantially horizontal and said first conveyor means is located at a level above said second conveyor means.

3. The combination of claim 1, further comprising means for severing the running web at said station, said severing means comprising a cross cutter.

4. The combination of claim 3, wherein said cross cutter comprises a first rotary knife holder at one side and a second rotary knife holder at the other side of said first path.

5. The combination of claim 1, wherein said means for adjusting said catcher assembly includes means for moving at least a portion of said assembly in a direction at an acute angle with reference to the direction of travel of sheets away from said station.

6. The combination of claim 5, further comprising means for guiding the catcher assembly during movement relative to said station.

7. The combination of claim 1, wherein at least one of the means for adjusting said conveyor means includes means for moving the respective conveyor means in substantial parallelism with said first path.

8. The combination of claim 7, further comprising guide means for confining said conveyor means to movements relative to each other in substantial parallelism with said first path.

9. The combination of claim 1, wherein one of said conveyor means includes a first portion and a second portion including a mouthpiece which is adjacent to said station and defines with the other of said conveyor means a nip for admission of successive sheets into said second path, and further comprising means for adjusting said mouthpiece relative to said first portion of said one conveyor means.

10. The combination of claim 9, wherein said second path is substantially horizontal and said one conveyor means is located at a level above said other conveyor means.

11. The combination of claim 9, wherein said means for adjusting said mouthpiece includes means for moving the mouthpiece substantially transversely of said second path.

12. The combination of claim 1, wherein at least one of the means for adjusting said conveyor means includes a rack and pinion drive.

13. The combination of claim 1, wherein said means for adjusting said catcher assembly includes a linkage.

14. The combination of claim 1, further comprising a suction chamber adjacent to one side of said second path and arranged to attract the leader of the web downstream of said station.

15. The combination of claim 14, wherein said second path is at least substantially horizontal and said suction chamber is located at a level below said second path.

16. The combination of claim 15, wherein said suction chamber is immediately or closely adjacent to said station and one of said conveyor means includes an adjustable mouthpiece located opposite said suction chamber so that the leader of the web advances between such chamber and said mouthpiece.

17. The combination of claim 1, wherein at least one of said conveyor means includes at least one endless flexible element.

18. The combination of claim 1, further comprising a frame, said means for adjusting said catcher assembly including means for moving said assembly relative to said frame and said catcher assembly further comprising wall means supporting said conveyor means, said means for adjusting said conveyor means including means for moving the respective conveyor means relative to said wall means.

19. The combination of claim 18, wherein said wall means includes a portion adjacent to said station and said means for adjusting said assembly includes means for moving said portion of said wall means at an acute angle with reference to the direction of advancement of the web along said first path.

* * * * *